United States Patent [19]

Ashton

[11] 4,226,190

[45] Oct. 7, 1980

[54] DISPLAY RACK

[76] Inventor: Richard D. A. Ashton, R.R. 1, Terra Cotta, Ontario, Canada

[21] Appl. No.: 962,168

[22] Filed: Nov. 20, 1978

[51] Int. Cl.[2] ..... A47B 7/00

[52] U.S. Cl. ..... 108/11; 108/91; 211/149

[58] Field of Search ..... 108/60, 111, 114, 91; 211/44, 49 R, 49 S, 149, 181, 188, 194, 195, 199

[56] References Cited

U.S. PATENT DOCUMENTS

| | | | |
|---|---|---|---|
| 1,235,679 | 8/1917 | Gerberich | 108/114 |
| 2,680,522 | 6/1954 | Temple | 211/149 X |
| 3,232,442 | 2/1966 | Wilson | 211/181 X |
| 3,717,259 | 2/1973 | Fried et al. | 211/181 X |

*Primary Examiner*—James C. Mitchell

*Attorney, Agent, or Firm*—George A. Rolston; William F. Frank

[57] ABSTRACT

A display rack having a back wall, and at least two side walls, and having hinge means interconnecting between respective side walls and the back wall, such hinge means being located at spaced apart intervals whereby the side walls may be swung flat against the back wall for shipping, and may be swung away therefrom for erection, and having shelving dimensioned to fit between the two side walls when the same are swung apart and the shelving having fastening means integral therewith interengageable with the side walls whereby the shelving may be secured along either side edge to respective side walls, in supporting relation thereto, and at the same time interlocking such side walls together is predetermined spaced apart relation so that they are no longer swingable with respect to the back wall, and forming a rigid three-dimensional structure.

8 Claims, 7 Drawing Figures

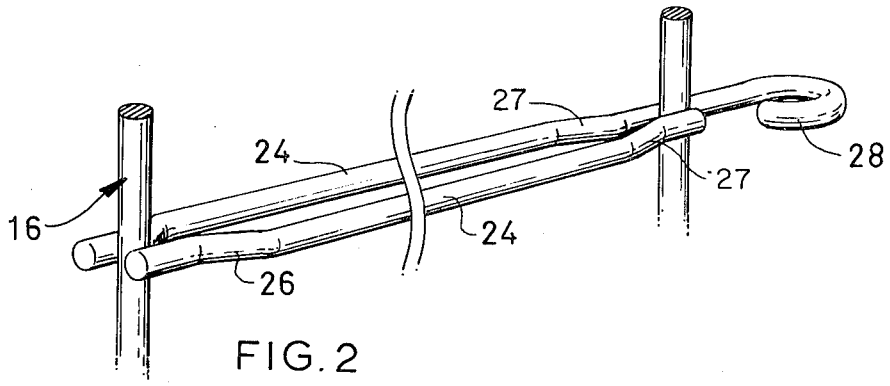
FIG. 2
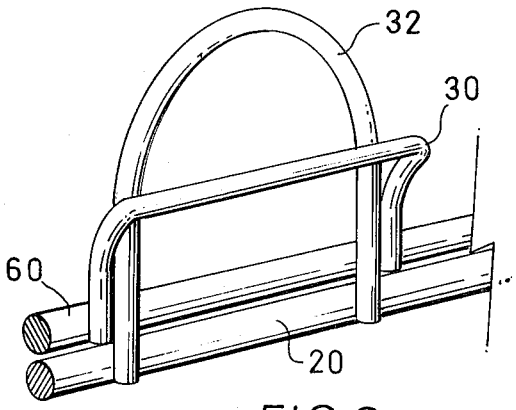
FIG. 3
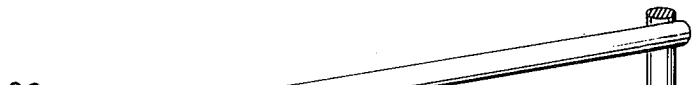

DISPLAY RACK

This invention relates to portable dismountable racks of shelving for the display and sale of merchandise.

BACKGROUND OF THE INVENTION

A great variety of different designs of display racks for merchandise have been proposed, which satisfy various objectives. Thus it is desirable both to display the merchandise attractively, and also to provide an actual point of sale, whereby the merchandise can be sold directly off the display, and thus incorporates its own storage capacity, and it is desirable also to incorporate some form of advertising display at such point of sale.

In addition to all of these factors however which are more or less self-evident, and in the past, have been achieved to a certain extent in a variety of different ways, it is also desirable that when setting up a new sales program, the manufacturer or supplier shall be able to provide to the vendor or retailer a complete package consisting of an inventory of the merchandise itself, and also display racks particularly designed to both display and sell the product with the maximum of customer appeal.

For bulky merchandise, in this particular case wallpaper, the construction, of large display racks following conventional techniques sufficient to hold quantities of wallpaper, and the shipping and erection of such racks, would be prohibitively expensive and require skilled labor.

It is particularly desirable that the display racks shall be especially designed to suit the particular characteristics of rolled wallpaper, and at the same time, shall be capable of being shipped out in a dismounted condition, and may be set up in a retail outlet with a minimum of skill i.e. by sales help available in the location, and without of any tools whatever.

BRIEF SUMMARY OF THE INVENTION

The invention seeks to provide the foregoing features, and comprises a display rack having a back wall, and at least two side walls, and having hinge means interconnecting between respective side walls and the back wall, such hinge means being located at spaced apart intervals whereby the side walls may be swung flat against the back wall for shipping, and may be swung away therefrom for erection, and having shelving dimensioned to fit between the two side walls when the same are swung apart and the shelving having fastening means integral therewith interengageable with the side walls whereby the shelving may be secured along either side edge to respective side walls, in supporting relation thereto, and at the same time interlocking such side walls together in predetermined spaced apart relation so that they are no longer swingable with respect to the back wall, and forming a rigid three-dimensional structure.

Preferably, the invention further comprises that there are two outer side walls, and at least one intermediate side wall, so that at least two adjacent sets of shelves may be arranged therebetween, with the intermediate side wall separating one such set of shelves from the next adjacent set.

Preferably, the invention further comprises that display panel means are also provided, comprising a display back wall and two display side walls, and hinge means between the side walls and the back wall whereby the same may be swung flat against the back wall for shipping, and may be swung open for display, the back wall of the display being essentially co-extensive with the back wall of the shelving, and the side walls of the display being essentially co-extensive with the side walls of the shelving, and there being supporting means on said support panels for supporting display cards thereon, and the display side walls having interlock means on their lower edges, and the shelving side walls having interlock means on their upper edges, such interlock means being interengageable whereby the said display side walls may be mounted vertically above the shelving side walls. In this way a rigid three-dimensional structure is provided in which the shelving effectively secures the side walls and holds them rigidly in position, and the display walls are securely held in place.

The various features of novelty which characterize the invention are pointed out with particularity in the claims annexed to and forming a part of this disclosure. For a better understanding of the invention, its operating advantages and specific objects, attained by its use, reference should be had to the accompanying drawings and descriptive matter in which there are illustrated and described preferred embodiments of the invention.

IN THE DRAWINGS

FIG. 2 is an enlarged detail of FIG. 1;

FIG. 3 is an enlarged cut away perspective illustration of the interlock means between the shelving side walls and the display side walls;

FIG. 4 is a cut away enlarged perspective of the shelving fastening means;

DESCRIPTION OF A SPECIFIC EMBODIMENT

Figure 1:
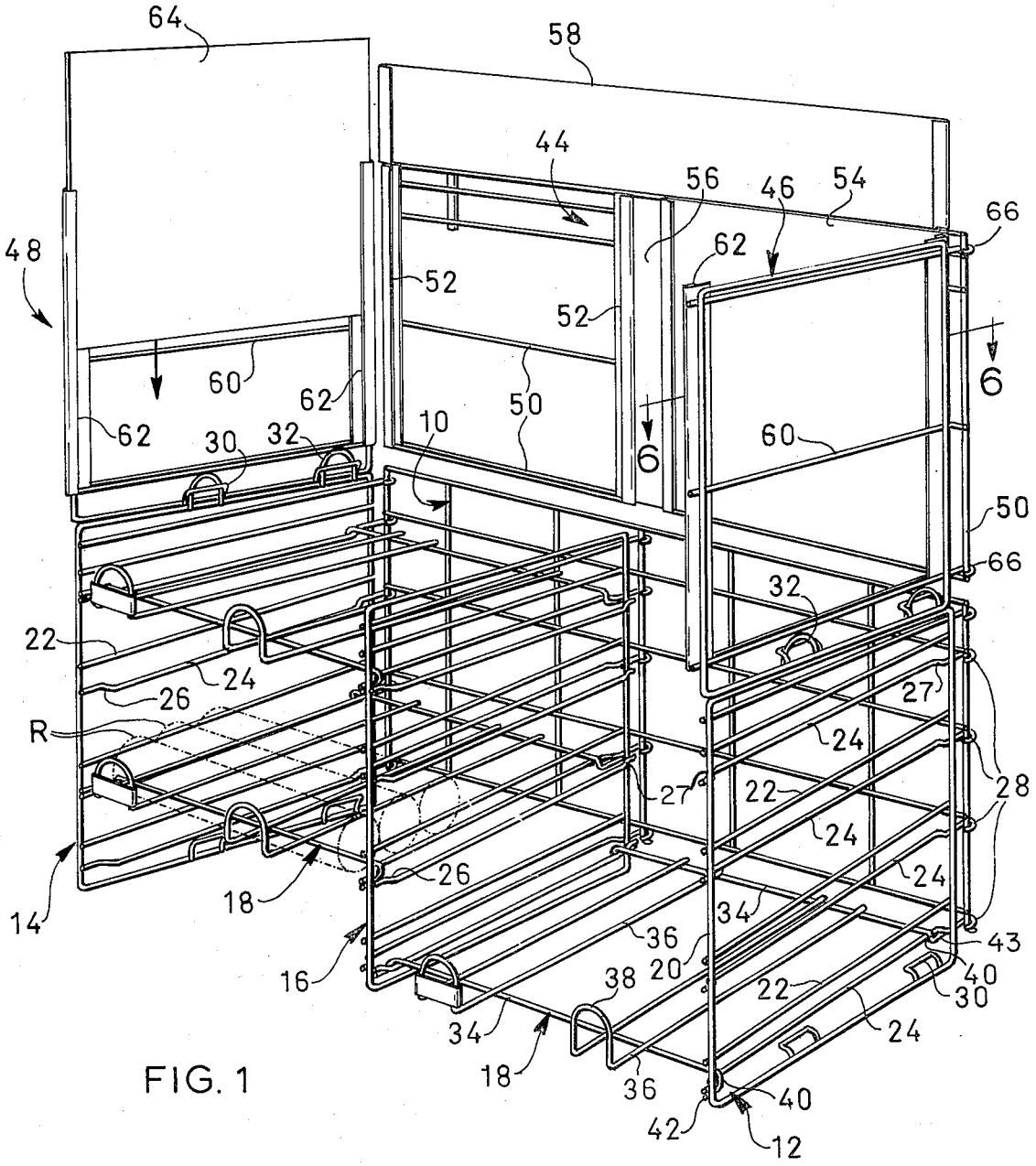
FIG. 1 is a front perspective illustration of a display rack according to the invention, shown with certain part thereof either disassembled or absent, for clarity.
Figure 5:
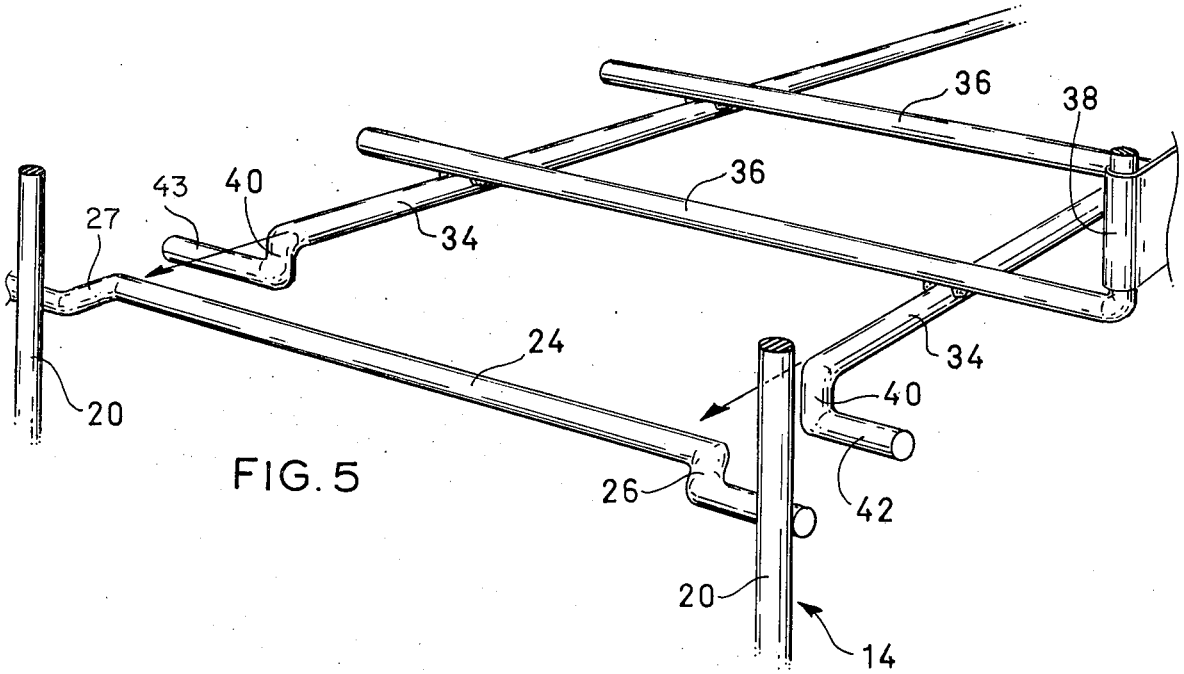
FIG. 5 is a view corresponding to FIG. 3, from another direction showing the two parts diassembled.
Figure 6:
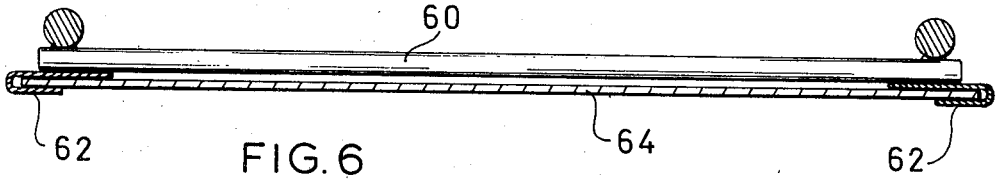
FIG. 6 is a fragmentary section along the line 6—6 of FIG. 1.
Figure 7:
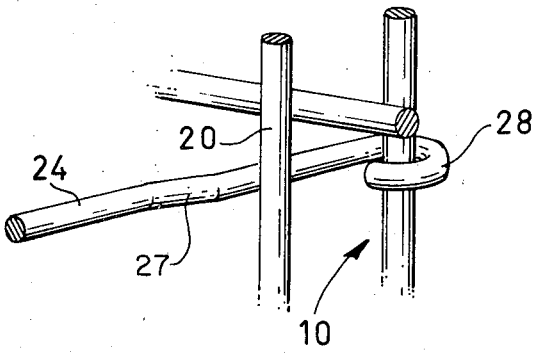
FIG. 7 is an enlarged perspective of the hinge means.

With reference first of all to FIG. 1, a display rack according to the invention is shown there and will be seen to comprise a shelving back wall 10, and shelving side walls 12 and 14 and an intermediate shelving side wall 16.

Shelving or racks 18 are supported between adjacent walls 12 and 16 and 14 and 16 respectively. Rolls R typically of wallpaper are shown in one of the shelves 18, the shelves 18 being downwardly angled, in a manner described hereinafter, whereby to ensure that the rolls advance to the front of the rack as they are purchased.

The shelving 18 will be of sufficient strength and depth that rolls R may be stacked two or three rolls deep, for greater storage capacity.

The back wall 10 will be seen to be constructed of a wire grid consisting of horizontal and vertical components, being spot welded to one another in a manner known per se and requiring no further description.

The outer side walls 12 and 14 are constructed in an identical, but mirror image manner. Thus the side wall 12 comprises a rectangular wire frame member 20, having a plurality of transverse shorter guide bars 22, and a plurality of longer support bars 24, spot welded thereto in spaced apart parallel relation as shown. The guide bars 22 are simply straight wire rods and perform a guide function locating the rolls R on the shelves 18. The longer support bars 24 are formed with two generally Z-shaped off-sets or bends indicated as 26 and 27, at opposite ends thereof adjacent to two vertical portions of the square frame 20, the rearward offset 27 being longer than the forward offset 26.

The rearwardly extending portion of each of rods 24 is formed into a loop or eye 28, which fits loosely around the vertical portion of the back wall 10, to provide a hinging action.

The intermediate or median side wall 16 comprises rectangular wire frame work 29, and similar guide bars 22, and longer support bars 24. However, it will be noted that support bars 24 are welded in pairs on opposite sides of frame 29, with one only of each pair having a loop 28 thereon, for hinging attachment to back wall 10.

In order to provide vertical interconnection, along the upper and lower edges of the side walls 12 and 14, for interconnection with the display panels or other similar shelving walls such as another back wall 10 and side walls 12 and 14, there are provided lower and upper interconnection means. The lower interconnection means on each of side walls 12 and 14 comprises more or less rectangularly shaped wire eyelets 30, the upper portions of which are turned inwardly, whereby the interior of the eyelet 30 may be penetrated in a vertical plane.

The upper interlocking means comprise generally D-shaped wire insert members 32, arranged in a vertical plane. The lower interconnection means namely the eyelets 30 are attached to the lower horizontal portion of the frames 20, and the upper interconnection means namely the C-shaped inserts 32 are fastened to the upper horizontal portion of frames 20. The inserts 32 are somewhat narrower than the eyelets 30, whereby the inserts 32 may be inserted, in a vertical plane, into corresponding eyelets 30 on the lower edges of the display walls described below.

Each shelf 18 is identical, and comprises a pair of transverse rods 34, and two pairs of longitudinal rods 36, joined at their foward ends and turned upwardly as at 38.

At each end of the transverse rods 34, the end of the rod is bent substantially vertically downwardly, at an intermediate section 40 and is then bent outwardly, through a right angle relative to the axis of the rod 34, to provide forward hook portion 42, and longer rearward hook portion 43.

The hooks 42 and 43 are interengageable with the Z-shaped offsets 26 and 27 of rods 24 and provide a rigid locked interconnection both at the front and back of each of shelves 18, with adjacent side walls 12 and 16 and 14 and 16 respectively.

Locking of the shelves 18 is achieved in three movements.

A. The shelf is held at an angle, with the rear lower than the front, and the longer hooks 43 are inserted around the rearward longer offsets 27, but inside the adjacent vertical portions of the rectangular frames.

B. The shelf is then swung down until the forward hooks 42 pass around the forward offsets 26.

C. The shelf is then drawn forwardly so that the forward hooks 42 pass inside the adjacent vertical portions of the rectangular frames, and the shelf is then locked. It will be noted that the longer offsets 27 provide space for such forward movement, while the longer hooks 43 are of such length that they continue to engage the rectangular frames, even when the shelf is drawn forwardly.

In this way, each shelf is secured at all four corners in a rigid manner, and the engagement of the hooks with the rectangular frames prevents any twisting movement of the side walls relative to the shelving.

It will of course be appreciated that the arrangement of the shelving side walls and intermediate wall may be varied in order to provide either smaller or larger displays, although the particular arrangement shown with two sets of shelving 18, supported by the two side walls 12 and 14 and the intermediate wall 16 is particularly suitable and effective and provides a good rigid display.

It will also be understood that if desired a second tier (not shown) of a shelving back wall, and side walls, and shelving, may be stacked on top of the first tier, being fastened by the interconnecting means described above. In this way double the storage capacity is provided without detracting from the usefulness or appeal of the first shelving tier.

In order to provide point of sale advertising and instructions to purchasers, an upper advertising display back wall 44 is provided, having two display side walls 46 and 48.

The display back wall 44 comprises a framework of vertical and horizontal rods 50, which in this case extends the same width as the width of the shelving back wall 10.

In order to support display advertising material, four vertical channel members 52 are fastened on the front of the frame 50, in two pairs, so that two separate display cards 54 can be slid between respective pairs of such channels 52. Typically such display cards will be of suitable cardboard material, printed with instructions for use advertising or the like, and may be changed from time to time depending upon the sales program currently in effect.

A median sheet metal panel 56 is located between the two pairs of channels 52, which may be permanently printed with further advertising material, or may serve as a support for advertising printed on adhesive backed paper or the like.

Similarly, a further upper display panel 58, also of sheet metal is provided along the upper edge of the frame 50 for carrying further advertising.

The display side walls 46 and 48 are of essentially the same construction as the back wall 44. They will thus be seen to comprise a wire framework 60, and spaced apart vertical metal channel 62, display card 64 may be slid between the channel 62.

Along the lower portion of each of frame 60, further connection eyes 30 are provided, for interconnection with the upstanding loops 32 on the upper edges of the shelving side walls 12 and 14.

There is no specific connection provided between the shelving back wall 10 and the display back wall 44.

Hingeable connections are effected between the display back wall 44 and the side walls 46 and 48, by means of wire loops 66.

In this way, the entire structure of the display back wall 44 and side walls 46 and 48 may be folded flat upon itself, for ease of shipping and storage. When folded flat, the entire structure will be relatively slim, and can easily be stored in a warehouse, and shipped out to customers as required, at a minimum cost.

Once erected however, and filled with product for sale, it forms an attractive rigid self supporting free standing display structure, which provides an attractive and at the same time efficient addition to the retail store. In particular, the entire structure being made of open frames, utilizing the inherent advantages of wire rod frame work, which combines both strength, with a maximum of open area, ensures two factors, mainly that the customers may view the actual product in the shelfs from various directions and thus be attracted to the display, without necessarily viewing it from in front, and at the same time provides an easy means whereby sales staff can readily check inventory of particular items, thereby ensuring that items do not become out of stock.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A display rack for displaying merchandise for sale, and storing additional merchandise, said rack comprising;

a shelving back wall;

at least two shelving side walls having forward and rearward edges and lower and upper edges;

hinge means on said rearward edges interconnecting said side walls with said back wall, whereby said side walls may be folded flat against said back wall, and may be swung apart when erected;

shelving support means integrally formed on one said side walls formed by offset bend portions formed of wire rod adjacent the forward and rearward ends thereof;

generally rectangular removable shelves dimensioned to fit between two adjacent said side walls when the same are in their swung apart erected position, said shelves being disengageable from said side walls and back wall for shipping and storage, and, interlock means on said shelves, at all four corners thereof, formed by wire rods defining forward hook portions at the front corners thereof, and rearward hook portions at the rear corners thereof, said forward hook portions being directed forwardly for interengagement with said forward offset bend portions, and said rearward hook portions being directed rearwardly for interengagement with said rearward offset bend portions, whereby when the same are interlocked, said shelving is firmly attached to said side walls at all four corners thereof, thereby providing a rigid three-dimensional structure, without the use of additional fastenings.

2. A display rack as claimed in claim 1 wherein there are three side walls, namely two outer side walls, and one intermediate side wall, and wherein said two outer side walls incorporate shelving support means on their inwardly directed faces, and wherein said intermediate side wall comprises shelving support means on both sides thereof, whereby shelving may be supported between said intermediate side wall, and said outer side walls on either side of said intermediate side wall.

3. A display rack as claimed in claim 1 wherein said side walls comprise rectangular open framework having horizontal and vertical portions and wherein said shelving support means comprise wire rod means extending from front to rear of said side walls and inclined to the horizontal, and fastened to vertical portions of said rectangular frames.

4. A display rack as claimed in claim 3 wherein said forward and rearward hook portions are of a predetermined length, with said rearward hook portions being longer than said forward hook portions, whereby the same may additionally interengage with vertical portions of said rectangular open frames, thereby providing rigid support at all four corners of each said shelf, and being releasable therefrom for disengagement of said shelves from said back wall and side walls as aforesaid.

5. A display rack as claimed in claim 1 including stop means on the forward edges of said shelves, whereby to retain merchandise thereon.

6. A display rack as claimed in claim 1 including wall interlock formation formed on both lower and upper edges of said side walls, the interlock formations on the lower side walls being adapted to interengage and interlock with the interlock formations on the upper edges, of adjacent said side walls, whereby further said side walls may be erected on the upper edges of the existing side walls, to provide successive tiers of display racks.

7. A display rack as claimed in claim 4 including wire rod spacer members fastened to vertical portions of said side walls, spaced above said shelving support means, whereby to engage and guide merchandise lying on said shelves.

8. A display rack as claimed in claim 1 including advertising display means adapted to be interengaged with, and supported on said back wall and said side walls, said advertising display means comprising display back wall means;

a display side wall means having forward and rearward edges and lower and upper edges;

hinge means on said rearward edges of said display side wall means interconnecting with said back wall, whereby said display side walls may be folded flat against said display back wall and may be swung apart when erected;

display card retaining means on said back wall;

display card retaining means on said display side walls, whereby display cards may be removably inserted therein, and, interlock means on the lower edges of said display side walls, for interengaging with the upper edges of said shelving side walls, whereby said advertising display means may be supported directly above and in alignment with respective shelving back walls and side walls.

* * * * *